US010455891B1

(12) United States Patent
Buford, Sr.

(10) Patent No.: US 10,455,891 B1
(45) Date of Patent: Oct. 29, 2019

(54) TRAINING SHOE

(71) Applicant: Marques D Buford, Sr., Bolingbrook, IL (US)

(72) Inventor: Marques D Buford, Sr., Bolingbrook, IL (US)

( * ) Notice: Subject to any disclaimer, the term of this patent is extended or adjusted under 35 U.S.C. 154(b) by 0 days.

(21) Appl. No.: 15/405,938

(22) Filed: Jan. 13, 2017

Related U.S. Application Data

(60) Provisional application No. 62/278,162, filed on Jan. 13, 2016.

(51) Int. Cl.

| | |
|---|---|
| ***A43B 5/00*** | (2006.01) |
| ***A43B 7/20*** | (2006.01) |
| ***A43C 1/00*** | (2006.01) |
| ***A43C 11/00*** | (2006.01) |
| ***A43C 11/14*** | (2006.01) |
| ***A43C 15/16*** | (2006.01) |
| ***A43B 3/00*** | (2006.01) |
| ***A43B 23/02*** | (2006.01) |
| ***A43B 7/14*** | (2006.01) |
| ***A43B 23/07*** | (2006.01) |

(52) U.S. Cl.
CPC ..... *A43B 7/20* (2013.01); *A43B 3/0078* (2013.01); *A43B 5/00* (2013.01); *A43B 7/1405* (2013.01); *A43B 23/028* (2013.01); *A43B 23/07* (2013.01); *A43C 1/00* (2013.01); *A43C 11/006* (2013.01); *A43C 11/1493* (2013.01); *A43C 15/161* (2013.01)

(58) Field of Classification Search
CPC ..... A43B 5/00; A43B 7/1405; A43B 7/1465; A43B 7/20; A43B 23/07
USPC ..... 36/88, 89, 93, 10, 55, 134, 114, 58.5, 51
See application file for complete search history.

(56) References Cited

U.S. PATENT DOCUMENTS

| | | | | | |
|---|---|---|---|---|---|
| 737,920 | A * | 9/1903 | Golden | A43B 5/06 | 36/11 |
| 811,438 | A * | 1/1906 | Rhodes | A43B 5/0405 | 36/11 |
| 859,382 | A * | 7/1907 | Hansen | A43B 5/06 | 36/129 |
| 910,505 | A * | 1/1909 | Corcoran | A43B 5/06 | 36/11 |
| 955,337 | A * | 4/1910 | Lawlor | A43B 11/00 | 36/105 |
| 1,392,704 | A * | 10/1921 | Pierce | A43C 15/167 | 152/210 |
| 1,542,671 | A * | 6/1925 | Craig | A43C 15/162 | 36/129 |
| 1,745,726 | A * | 2/1930 | Snow | A43B 23/28 | 36/58.5 |
| 1,855,452 | A * | 4/1932 | Jones | A43B 5/06 | 152/210 |

(Continued)

*Primary Examiner* — Marie D Bays
(74) *Attorney, Agent, or Firm* — Cramer Patent & Design, PLLC; Aaron R. Cramer

(57) ABSTRACT

An athletic training shoe has an outsole and an upper shoe portion. The portion of the outsole adjacent the front foot cavity has a plurality of molded cleats. The portion of the outsole adjacent the heel cavity is arched up and away from the cleat portion. About the circumference of an opening of the upper shoe body are cushioned hemispherical protuberances, acting as an ankle stabilizer for a wearer of the shoe. This ankle stabilizer can be inserted in the shoe upper or integral therewith.

5 Claims, 5 Drawing Sheets

(56) References Cited

U.S. PATENT DOCUMENTS 1,878,419 A * 9/1932 McCarthy ..... A43B 23/28 36/58.5
1,966,179 A * 7/1934 Lesch ..... A43B 23/28 36/58.5
2,506,559 A * 5/1950 Pierce ..... A43B 5/06 36/105
2,722,756 A 11/1955 Ecclesine
3,003,154 A * 10/1961 Litman ..... A41B 11/00 2/239
3,419,974 A * 1/1969 Lange ..... A43B 1/0018 12/142 R
3,581,414 A 6/1971 Crawford
3,626,610 A * 12/1971 Dassler ..... A43B 5/06 36/129
3,693,270 A * 9/1972 Murray ..... A43B 19/00 36/58.5
3,768,182 A * 10/1973 Powers ..... A43B 5/00 36/114
3,808,713 A 5/1974 Dassler
4,079,527 A * 3/1978 Antonious ..... A43C 11/008 36/50.1
4,327,503 A 5/1982 Johnson
4,385,456 A * 5/1983 Livernois ..... A43B 3/0047 36/115
4,451,995 A * 6/1984 Antonious ..... A43B 23/047 36/51
4,748,750 A 6/1988 George
4,748,753 A * 6/1988 Ju ..... A43B 5/001 36/127
4,837,949 A 6/1989 Dufour
5,295,315 A * 3/1994 Osawa ..... A43C 11/06 24/712
5,339,544 A * 8/1994 Caberlotto ..... A43B 5/02 36/102
5,946,825 A * 9/1999 Koh ..... A43B 13/40 36/37
6,006,454 A 12/1999 Sitzler, Sr.
6,018,893 A * 2/2000 Workman ..... A43C 15/00 36/134
6,079,128 A * 6/2000 Hoshizaki ..... A43B 23/16 36/115
6,312,361 B1 * 11/2001 Hayes ..... A43B 3/20 36/106
6,442,875 B1 * 9/2002 Joubert ..... A43B 5/0405 36/115
7,140,128 B2 * 11/2006 Huckle ..... A43B 7/12 36/54
7,225,563 B2 * 6/2007 Chen ..... A43B 3/26 36/10
8,215,032 B2 * 7/2012 Sokolowski ..... A43B 23/0235 36/133
8,745,899 B2 * 6/2014 Schenone ..... A43B 3/26 36/97
2009/0249649 A1 * 10/2009 Schenone ..... A43B 3/26 36/97
2016/0058108 A1 * 3/2016 Schiller ..... A43B 13/04 36/134
2016/0192742 A1 * 7/2016 Baucom ..... A43C 15/161 36/134

* cited by examiner

TRAINING SHOE

RELATED APPLICATIONS

The present invention is a continuation-in-part of, was first described in, and claims the benefit of U.S. Provisional Application No. 62/278,162, filed Jan. 13, 2016, the entire disclosures of which are incorporated herein by reference.

FIELD OF THE INVENTION

The present invention relates generally to the field of athletic footwear and more specifically relates to agility training footwear.

BACKGROUND OF THE INVENTION

Athletic shoes are designed in a range of shapes and styles suitable for various activities such as running, dancing, and jumping. Necessary attributes of an athletic shoe include a flexible sole, appropriate tread for the function, and the ability to absorb impact. Athletic shoes are made of flexible compounds, typically featuring a sole made of dense rubber. While the original design was basic, manufacturers have since tailored athletic shoes for the different purposes of use. As the industry and designs have evolved, the term "athletic shoes" focuses more on the design of the bottom of the shoe than the aesthetics of the top of the shoe.

Generally, athletic shoes for runners are categorized by the style and ability of the runner, with the majority made for heel-toe joggers/runners and constructed with a structure of "rubber" and stiffeners to restrict foot movement. Other runners wear flatter and flexible shoes, which they perceive will allow them to run more quickly with greater comfort.

Another running technique is to train the runner to overcome the natural tendency to initially contact the ground with the heel and shift forward from the heel to the ball of the foot until the foot loses contact with the ground during the forward stride. Athletic shoes that prevent the heels of the feet from contacting the ground while supporting the toes and ball of the foot benefit this running style.

Various attempts have been made to solve problems found in training shoe art. Among these are found in: U.S. Pat. No. 4,040,192 to Jose Miguel Perez, U.S. Pat. No. 4,187,623 to Armin Dassler, and U.S. Pat. No. 5,694,706 to Ettienne Penka. These prior art references are representative of training shoes.

None of the above inventions and patents, taken either singly or in combination, is seen to describe the invention as claimed. Thus, a need exists for a reliable, training shoe system, and to avoid the above-mentioned problems.

SUMMARY OF THE INVENTION

In order to achieve the object of providing such a training shoe, one (1) aspect of the invention is to provide a shoe having a shoe upper body incorporating a shoe opening capable of enabling a wearer to insert their foot, a tongue, and a fastener to secure the shoe to the wearer. An ankle stabilizer is configured to be placed in the opening of the shoe upper body and abut the inner circumference of the shoe upper body and the tongue. The ankle stabilizer prevents unwanted lateral or longitudinal movement of the wearers ankle when the shoe is worn and also provides cushioning from an impact. In certain embodiments, the ankle stabilizer can be an integral art of the shoe and tongue portions. to the inner portion. A further feature of the shoe is a cleat platform only attached to the forward portion of the bottom of the shoe upper body.

Another object of the invention is to provide different types of fasteners for fastening the hoe to the wearer, such as a lace capable of being routed through a plurality of eyelets located on the shoe upper body on either side of the tongue, an elastic fastener, or a hook-and-loop-type of fastener.

Another object of the invention is to have the cleat platform have a plurality of cleats either removably attached to the cleat platform or be integrally molded with the cleat platform.

Yet another object of the invention is to provide such an ankle stabilizer having four (4) points of cushioning, fashioned as a plurality of hemispherical protuberances defining an opening through which a user can place their foot so the ankle rests against the protuberances.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
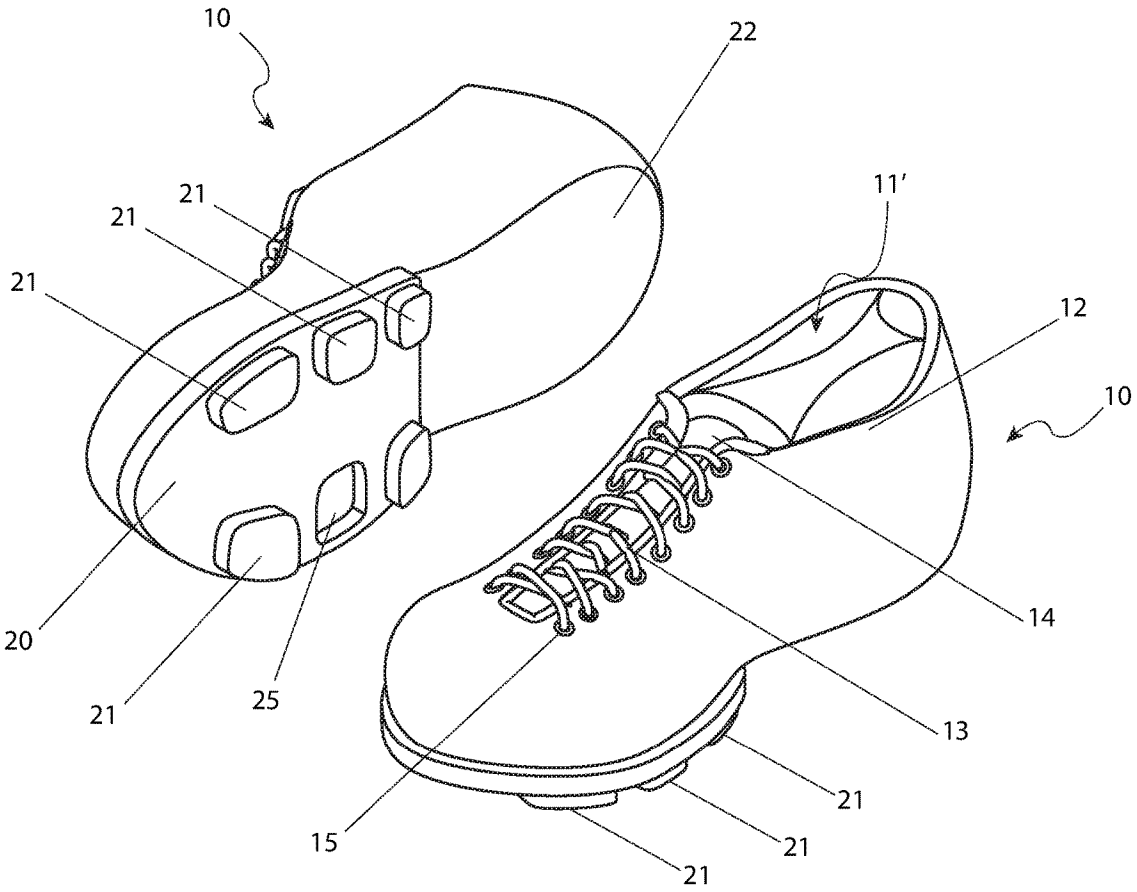
FIG. 1 are perspective views of a pair of training shoes 10, according to an embodiment of the present invention.

10 training shoe
11 ankle stabilizer
11' alternate ankle stabilizer
12 shoe upper
13 fastener
14 tongue
15 eyelet
20 cleat platform
21 cleat
22 heel portion
25 aperture
30 cushion point
30' alternate contact point
30" alternate tongue contact point
35 shoe opening
50 user
55 grade
60 angular displacement
65 shoe sole
70 ball area

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Figure 2:
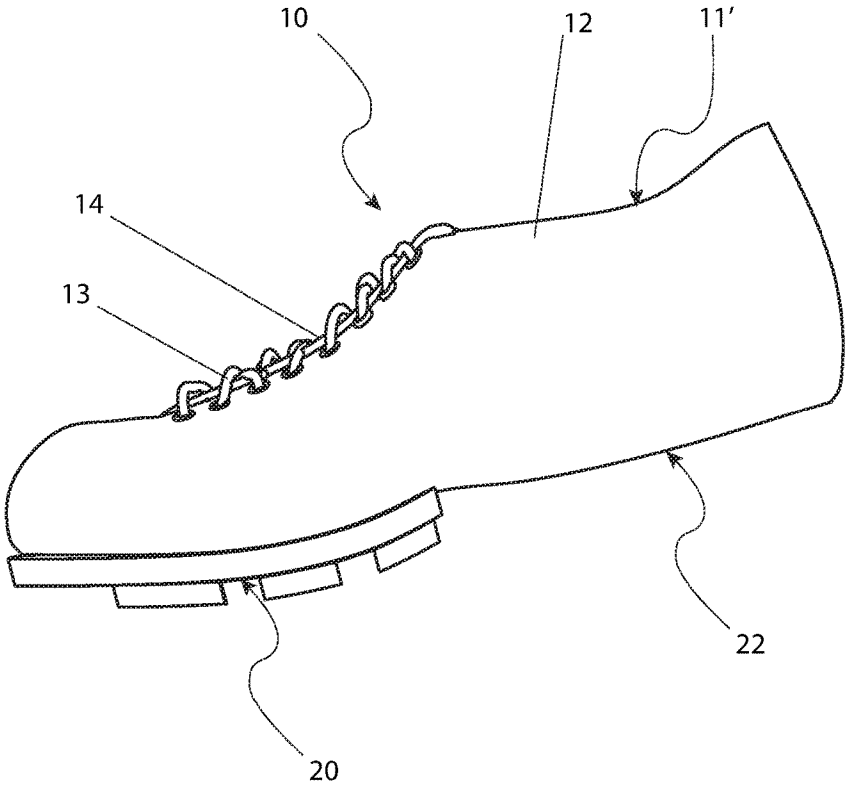
FIG. 2 is a side perspective view of an individual training shoe 10, according to an embodiment of the present invention.

The present invention is directed to a training shoe 10. In one (1) embodiment of the present invention, the training shoe 10 may comprise an athletic training shoe 10 for the purpose of training a user 50 to increase athletic agility, quickness, and speed on a plurality of surfaces. Referring to the drawings, there is shown in FIGS. 1-2, the training shoe 10 comprising a four-point ankle stabilizer 11 located on the inner surface of the shoe opening of the shoe upper 12. As shown, the four-point ankle stabilizer 11 may be used in combination with the training shoe 10 which lacks the traditional heel structure, along with a cleat platform 20 to support both the ball of the foot and the toes while performing on turf and/or grass. The shoe 10 would have other expected features such as a tongue 14 attached at a first end to a forward location of the upper surface of the shoe upper 12 and extending rearwards to the shoe opening 35, and a fastener 13 located on either side of the tongue 14 to fasten the shoe 10 to the user 50.

The molded cleat platform 20 may comprise cleats 21 fashioned as textured nodules that may be repeatedly placed into and from a similarly sized aperture 25 on the cleat platform 20 to provide for a multitude of personalized configurations. Such a connection is preferably snap or friction fit. Other embodiments provide for the cleats 21 to be molded to the platform 20. As such, a user 50 such as an athlete may increase forward velocity, improve agility and/or develop skills such as changing direction during a vertical jump.

Preferably, the training shoe 10 may comprise a two inch (2 in.) molded cleat platform 20 lift in the forward portion of the shoe 10, and no cleat platforms 20 or cleats 21 on the heel portion 22. The absence of support on the heel portion 22 encourages the user 50 to rest his or her in contact with the ground during activities such as running, backpedaling or resting (or other cardiovascular activity). As such, the user 50 remains on the balls of the feet, thus encouraging quickness, speed, and agility.

As may be appreciated, the training shoe 10 may comprise a representative quantity of sizes and widths to accommodate male and female users 50. The training shoe 10 may comprise at least one (1) fastener 13, which can be a hook-and-loop type material (such as VELCRO®, illustrated in FIG. 3), an elastic material (illustrated in FIG. 5), or a shoe lace routed through a plurality of eyelets (illustrated in FIG. 1). The least one (1) fastener 13 may be a pair of hook-and-loop fastener straps 13A extending across the tongue 14 of the upper shoe body 12.

Preferably, the training shoe 10 may comprise at least two (2) locations to incorporate trademarked logo information or other branding indicia. Preferably, the locations to incorporate trademarked logo information may provide structure to contribute to the strength, stability, or support of the training shoe 10.

Figure 3:
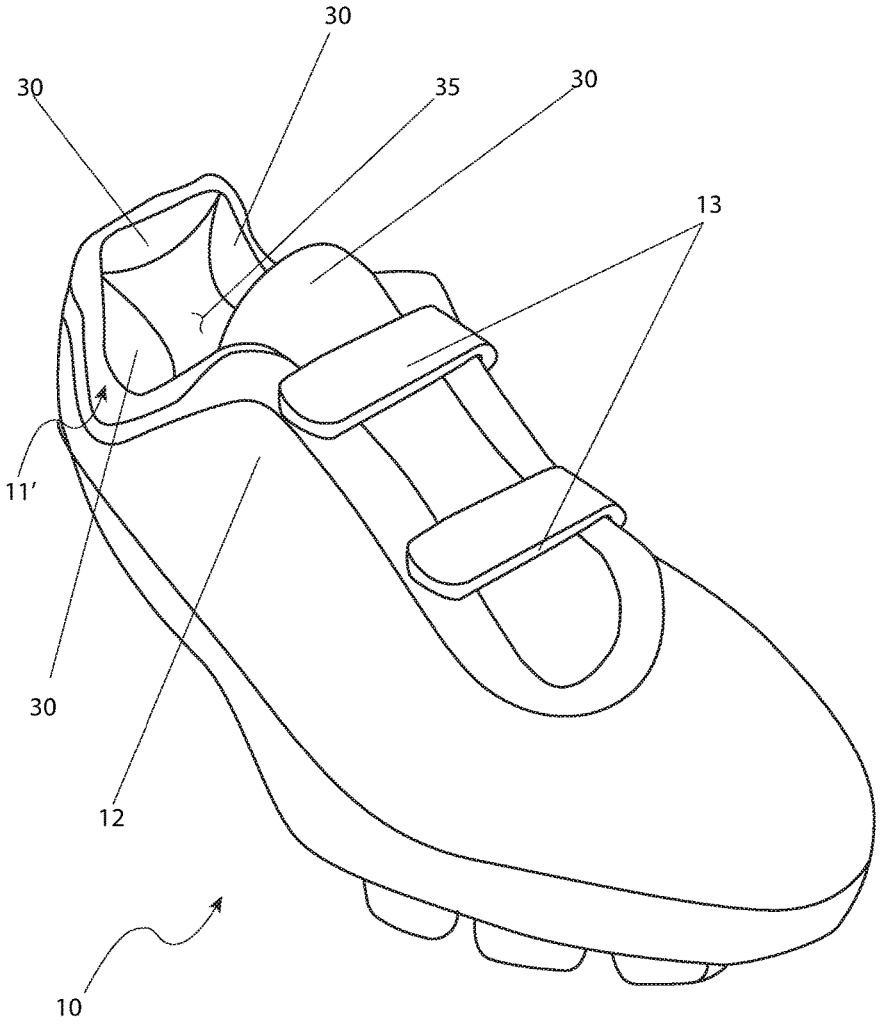
FIG. 3 is a perspective view of an individual training shoe 10, according to an embodiment of the present invention.

Referring now to FIG. 3, a top perspective view of the training shoe 10, according to an embodiment of the present invention is shown. This view provides an enhanced observation of the ankle stabilizer 11 which includes, in a preferred embodiment, of four (4) cushion points 30. The ankle stabilizer 11 is capable of being located on the inner surface of the shoe opening 35 of the shoe upper 12. The ankle stabilizer 11 is made of durable foam cushion material. The four (4) cushion points 30 are generally curvilinear at a first end and generally linear at a second end, thereby providing a somewhat hemispherical shape that is bulbous. This shape provides additional comfort, ankle support, and snug effect, for users 50 who use the shoe 10. The ankle stabilizer 11 is capable of cushioning the ankle of a user 50 from impact as well stabilizing the ankle during lateral or longitudinal movement relative to the ankle stabilizer 11, particularly when performing athletic activities. In order to accomplish this, the ankle stabilizer 11, once fitted within the shoe upper 12, is oriented such that the first ends of each of the contact points 30 are facing inward. It should be noted that in a preferred embodiment, the ankle stabilizer 11 is not physically attached to the shoe upper 12, and is designed to remain within the shoe opening 35 of the training shoe 10. Other embodiments (such as that illustrated in FIG. 5) may provide that the alternate ankle stabilizer 11 is an integral part of the shoe upper 12. In such an embodiment, an alternate ankle stabilizer 11' comprises either three (3) alternate contact points 30' (left side, right side, and rear) with the tongue 14 providing the fourth point of stabilization, or an alternate tongue contact point 30" is integral with the tongue 14 provides the fourth point of stabilization.

Figure 4:
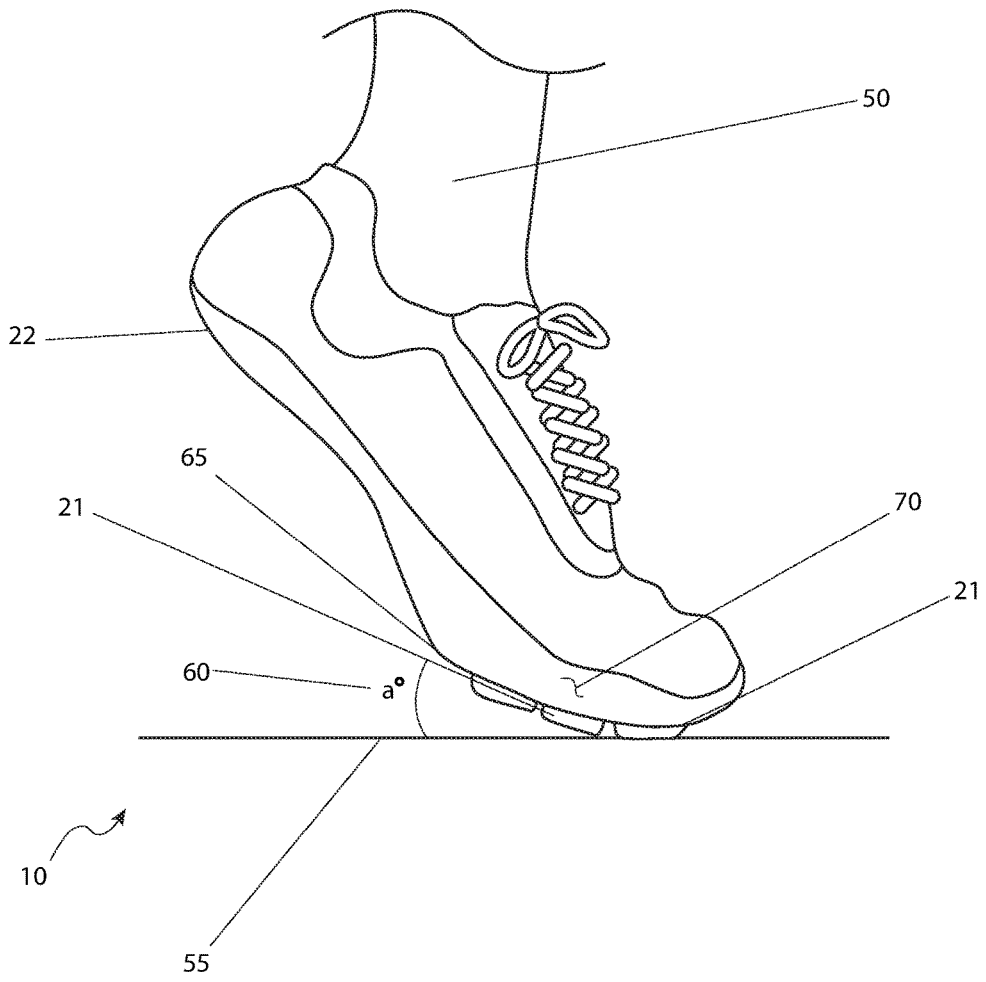
FIG. 4 is a perspective view of an individual training shoe 10, shown in use, according to an embodiment of the present invention; and, FIG. 5 is a top view of an individual training shoe 10 with an alternate ankle stabilizer 11', according to an embodiment of the present invention.
Figure 5:
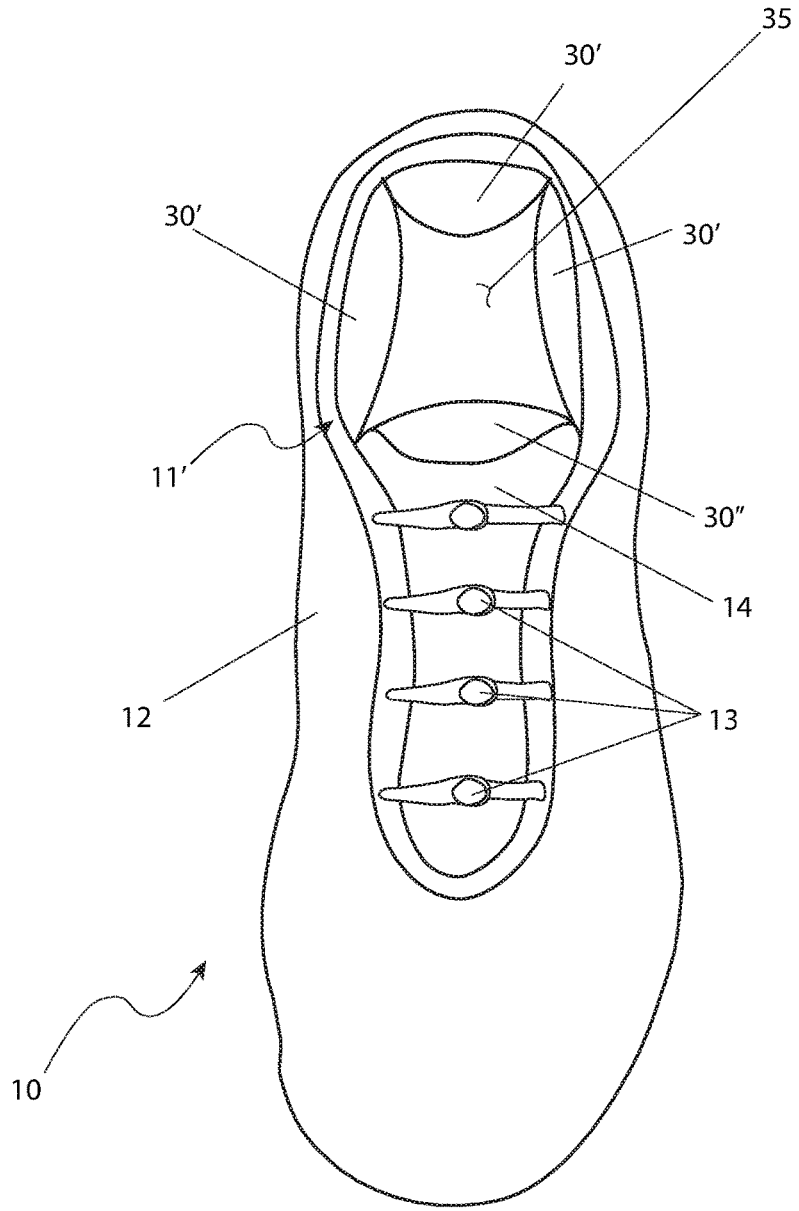

Referring finally to FIG. 4, a perspective view of the training shoe 10, shown in use, according to an embodiment of the present invention is depicted. This figure discloses a user 50 in active utilization of the training shoe 10. One (1) or more of the cleat(s) 21 are in contact with grade 55. This action produces an angular displacement "a" 60 between the grade 55 and shoe sole 65. Such use and action keeps the heel portion 22 off of the grade, thus allowing the user 50 to remain on the ball area 70 of the foot to provide maximum agility at all times.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A shoe, comprising:

an upper shoe body having an opening, a tongue, a bottom, and a fastener;

an ankle stabilizer inserted into an upper perimeter of said opening, abutting an inner circumferential surface of said shoe upper and said tongue;

a cleat platform coextensive with a forward portion of said upper shoe body bottom and affixed to a bottom perimeter edge thereof; and a plurality of cleats each coupled to said cleat platform, said each cleat is coupled to a selective location on said cleat platform;

wherein a heel portion of said upper shoe body bottom is exposed, without said cleats being coupled to said heel portion; and wherein said fastener is securing said shoe to a foot of a user;

wherein said fastener is at least one hook-and-loop fastener material extending across said tongue of said upper shoe body;

wherein said at least one hook-and-loop fastener material;

wherein said ankle stabilizer comprises four protuberances defining an interior;

wherein said interior permits passage of a foot of said user therethrough when donning said shoe;

wherein said four protuberances are providing a cushioning effect and a stabilizing effect to an ankle of said user; and wherein said ankle stabilizer is foam cushion material.

2. The shoe of claim 1, wherein said cleats are a plurality of textured nodules.

3. A shoe, comprising:

an upper shoe body having an opening, a tongue, a bottom, and a fastener;

an ankle stabilizer located within an upper perimeter of said opening;

a cleat platform coextensive with a forward portion of said upper shoe body bottom and affixed to a bottom perimeter edge thereof; and a plurality of cleats each coupled to said cleat platform, said each cleat is coupled to a selective location on said cleat platform;

wherein a heel portion of said upper shoe body bottom is exposed, without said cleats being coupled to said heel portion;

wherein said fastener is securing said shoe to a foot of a user;

wherein said fastener is at least one hook-and-loop fastener material extending across said tongue of said upper shoe body;

wherein said at least one hook-and-loop fastener material;

wherein said ankle stabilizer comprises a plurality of protuberances attached to opposing sides and a rear of an inner surface of said upper shoe body at said opening;

wherein a space between said protuberances and said tongue permits the passage of a foot of said user therethrough when donning said shoe;

wherein said ankle stabilizer comprises four said protuberances defining an interior wherein said four protuberances are providing a cushioning effect and a stabilizing effect to an ankle of said user; and wherein said ankle stabilizer is foam cushion material.

4. The shoe of claim 3, wherein said cleats are a plurality of textured nodules.

5. The shoe of claim 3, wherein said ankle stabilizer comprises a plurality of first protuberances attached to opposing sides and a rear of an inner surface of said upper shoe body;

wherein a space between said first protuberances and said second protuberances permit the passage of a foot of said user therethrough when donning said shoe; and wherein said first and second protuberances are providing a cushioning effect and a stabilizing effect to an ankle of said user.

* * * * *